US007710378B2

(12) United States Patent
Takamura et al.

(10) Patent No.: US 7,710,378 B2
(45) Date of Patent: May 4, 2010

(54) DRIVE APPARATUS OF LIQUID CRYSTAL DISPLAY DEVICE

(75) Inventors: Satoshi Takamura, Tokyo (JP); Hidetoshi Okazaki, Tokyo (JP); Hiroaki Inoue, Tokyo (JP)

(73) Assignee: Oki Semiconductor Co., Ltd. (JP)

( * ) Notice: Subject to any disclaimer, the term of this patent is extended or adjusted under 35 U.S.C. 154(b) by 793 days.

(21) Appl. No.: 11/507,497

(22) Filed: Aug. 22, 2006

(65) Prior Publication Data

US 2007/0097055 A1 May 3, 2007

(30) Foreign Application Priority Data

Oct. 31, 2005 (JP) ..... 2005-316221

(51) Int. Cl.
*G09G 3/36* (2006.01)

(52) U.S. Cl. ..... 345/96; 345/87; 345/209

(58) Field of Classification Search ..... 345/87–103
See application file for complete search history.

(56) References Cited

U.S. PATENT DOCUMENTS 4,525,710 A * 6/1985 Hoshi et al. ..... 345/90
4,622,590 A * 11/1986 Togashi ..... 348/792
4,926,168 A * 5/1990 Yamamoto et al. ..... 345/58
5,093,655 A * 3/1992 Tanioka et al. ..... 345/96
2005/0078074 A1* 4/2005 Morita ..... 345/96
2005/0088394 A1* 4/2005 Chung ..... 345/96
2005/0104835 A1* 5/2005 Misonou et al. ..... 345/96
2005/0190138 A1* 9/2005 Jung ..... 345/96
2005/0259061 A1* 11/2005 Aoki ..... 345/96

FOREIGN PATENT DOCUMENTS

JP 07-253565 10/1995

* cited by examiner

*Primary Examiner*—Alexander Eisen
*Assistant Examiner*—Nelson Lam
(74) *Attorney, Agent, or Firm*—Studebaker & Brackett PC; Donald R. Studebaker

(57) ABSTRACT

An apparatus includes a polarity reversing section which generates a polarity reversing signal for the liquid crystal drive voltage; a liquid crystal driver which reverses the polarity of the liquid crystal drive voltage based on the polarity reversing signal to drive the liquid crystal display panel; a warning signal generation section which generates a warning signal indicating the polarity reverse before the polarity of the liquid crystal drive voltage is reversed; and a regulator section which controls a supply of the liquid crystal drive voltage in accordance with the warning signal.

5 Claims, 10 Drawing Sheets

- PRIOR ART -

- PRIOR ART -

DRIVE APPARATUS OF LIQUID CRYSTAL DISPLAY DEVICE

BACKGROUND OF THE INVENTION

1. Field of the Invention

The present invention relates to a drive apparatus of a liquid crystal display device and, more specifically, to a drive apparatus of a passive and active matrix liquid crystal display device.

2. Description of the Related Art

A liquid crystal display device of conventional type carries therein X and Y electrodes in a matrix, and performs display by driving a liquid crystal material disposed at electrode intersections.

FIG. 1 is a schematic diagram showing the configuration of such a conventional liquid crystal display device. The liquid crystal display device is configured by a liquid crystal module controller 101, a liquid crystal module (LCM) 102, a power supply 111, and a regulator 103.

The liquid crystal module (LCM) 102 includes a liquid crystal panel, a common/segment driver which drives the liquid crystal panel, and a module controller (not shown) which controls the operation of the driver or others, for example.

The liquid crystal module controller 101 includes a data transfer clock generation circuit 105, a display data generation circuit 106, a synchronizing signal generation circuit 107, and an alternating signal generation circuit 108. To the liquid crystal module (LCM) 102, these components provide supplies of, respectively, a transfer clock CLK, display data DATA, horizontal and vertical synchronizing signals (HSYNC, VSYNC), and an alternating signal (hereinafter, also referred to as alternating signal DF). The liquid crystal control module device 101 is connected to a microprocessor unit (MPU) 110 via a system bus 117, and performs display control for the liquid crystal module (LCM) 102 under the control of the MPU 110.

The liquid crystal module (LCM) 102 receives a drive current from the power supply 111 through the regulator 103.

As described above, the liquid crystal module (LCM) 102 receives an alternating signal, and the liquid crystal panel is subjected to alternating drive. That is, the drive voltage for application to the common electrode and the segment electrode of the liquid crystal module (LCM) 102 is reversed in polarity in accordance with an alternating signal.

FIG. 2 schematically shows an alternating signal and a drive current for supply from the regulator 103 to the liquid crystal module (LCM) 102. As shown in FIG. 2, every time the alternating signal is reversed, a high level of current I2 flows with a spike or surge peak. The current flow of such a high level has been resulted in problems of causing unstable or erroneous operation of the liquid crystal display device. As an example, refer to Japanese Laid Open Patent Application Kokai No. H07-253565.

When the regulator 103 has the current supply capability of about a level of a normal current (I1 of FIG. 2), there needs to include a large-capacity capacitor for supply of the peak current I2. In this instance, however, the device size is increased, and the cost is also increased.

Considered here is a case where the regulator 103 is increased in its current supply capability to a level possible to supply the peak current I2. In this case, however, the regulator 103 will be mostly involved in the supply of the normal level of current I1 when it is in operation. The regulator 103 thus operates mainly in the region with poor conversion efficiency, and thus the power consumption is increased.

SUMMARY OF THE INVENTION

The present invention is made in consideration of such problems, and an object thereof is to provide a drive apparatus that is for use in a liquid crystal device, and can make the liquid crystal display device stably operate with less power consumption.

An aspect of the present invention, there is provided a drive control apparatus for use in a liquid crystal display device that applies, based on display data, a liquid crystal drive voltage to electrodes of a liquid crystal display panel for display. The apparatus includes: a polarity reversing section which generates a polarity reversing signal for reversing a polarity of the liquid crystal drive voltage; a liquid crystal driver which reverses the polarity of the liquid crystal drive voltage based on the polarity reversing signal to drive the liquid crystal display panel; a warning signal generation section which generates a warning signal indicating the polarity reverse before the polarity of the liquid crystal drive voltage is reversed; and a regulator section which controls a supply of the liquid crystal drive voltage to the liquid crystal driver in accordance with the warning signal.

Another aspect of the present invention, there is provided a drive control apparatus for use in a liquid crystal display device which applies, based on display data, a liquid crystal drive voltage to an electrode of a liquid crystal display panel for display. The apparatus comprises: a polarity reversing section which generates a polarity reversing signal for reversing a polarity of the liquid crystal drive voltage; an alternating liquid crystal driver which reverses the polarity of the liquid crystal drive voltage based on the polarity reversing signal to drive the liquid crystal display panel; a register which in advance stores therein a length of a drive power change period of the liquid crystal display panel; and a regulator section which increases a power supply to the liquid crystal display panel over the drive power change period before and after polarity reverse of the liquid crystal drive voltage.

DETAILED DESCRIPTION OF THE INVENTION

Figure 1:
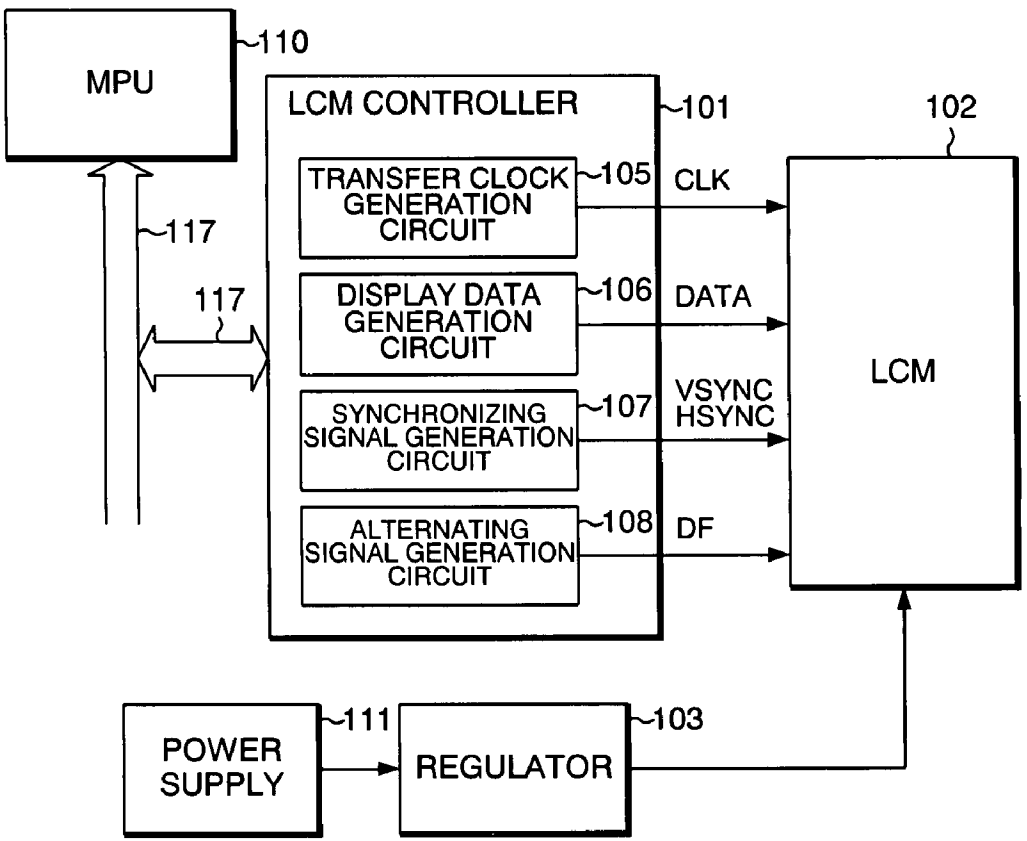
FIG. 1 is a schematic diagram showing the configuration of a conventional liquid crystal display device.
Figure 2:
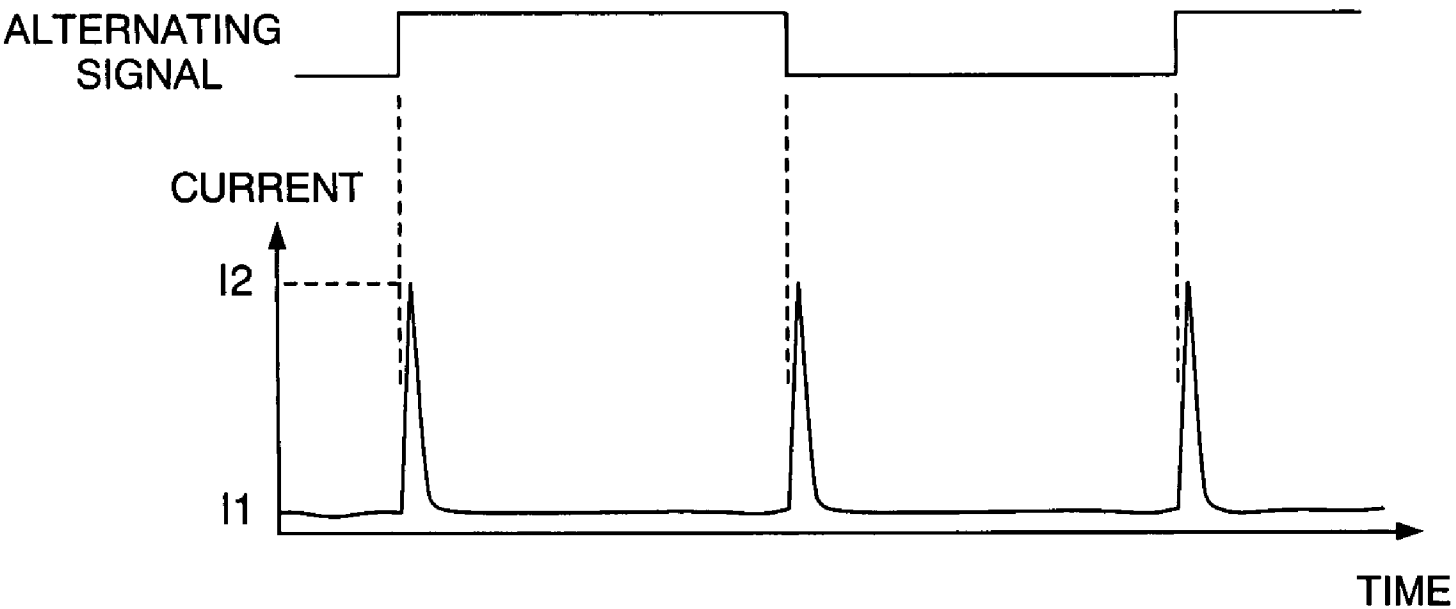
FIG. 2 is a schematic diagram showing an alternating signal and a drive current to be supplied from a regulator to a liquid crystal module (LCM)

In the below, embodiments of the present invention are described in detail by referring to the accompanying drawings. In the drawings, any components and elements those substantially the same or similar are provided with the same reference numerals.

First Embodiment

Figure 3:
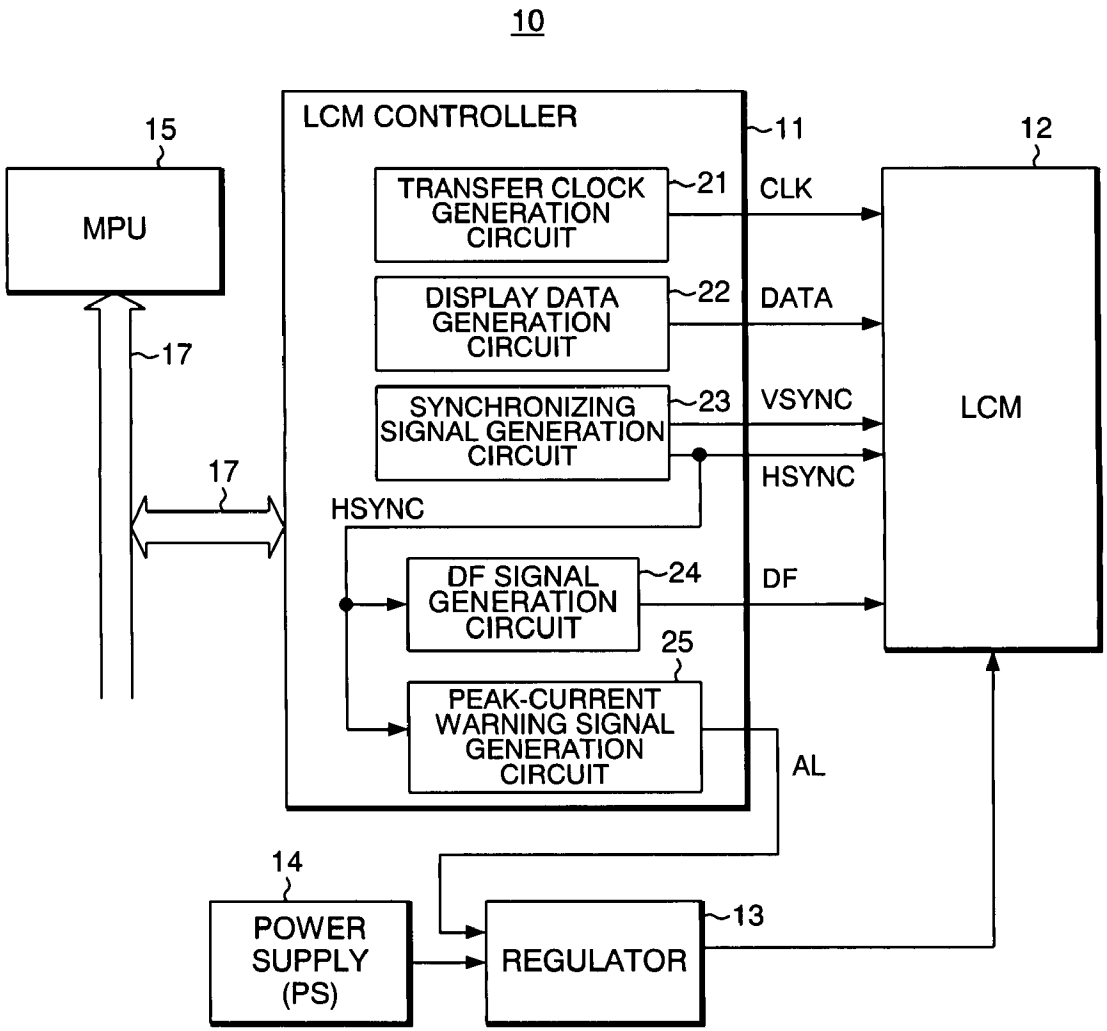
FIG. 3 is a schematic diagram showing the configuration of a liquid crystal display device of the present invention.

FIG. 3 is a schematic diagram showing the configuration of a liquid crystal display device 10 in a first embodiment of the present invention.

The liquid crystal display device 10 is configured to include a liquid crystal module (LCM) controller 11, a liquid crystal module (LCM) 12, a power supply 14, and a regulator 13. The liquid crystal module (LCM) controller 11 is connected to a microprocessor (MPU) 15 via a system bus 17, and performs display control for the liquid crystal module (LCM) 12 under the control of the MPU 15.

The liquid crystal module controller 11 includes a transfer clock generation circuit 21, a display data generation circuit 22, a synchronizing signal generation circuit 23, and an alternating signal (or DF signal) generation circuit 24. The transfer clock generation circuit 21 generates a synchronizing clock (CLK) of a predetermined frequency (predetermined cycle) for data transfer. The display data generation circuit 22 receives a data signal from the outside of the liquid crystal display device 10 via a data bus and the like, and converts the data signal into display data for display on the liquid crystal module (LCM) 12. The synchronizing signal generation circuit 23 generates a horizontal synchronizing signal (HSYNC) and a vertical synchronizing signal (VSYNC). The alternating signal (DF signal) generation circuit 24, provided in the liquid crystal module controller 11, generates an alternating signal (hereinafter, also referred to as DF signal).

The liquid crystal module (LCM) 12 receives a transfer clock (CLK), display data (DATA), horizontal and vertical synchronizing signals (HSYNC, VSYNC), and an alternating (DF) signal.

The liquid crystal module (LCM) 12 also receives a drive power from the power supply 14 via the regulator 13.

Figure 4:
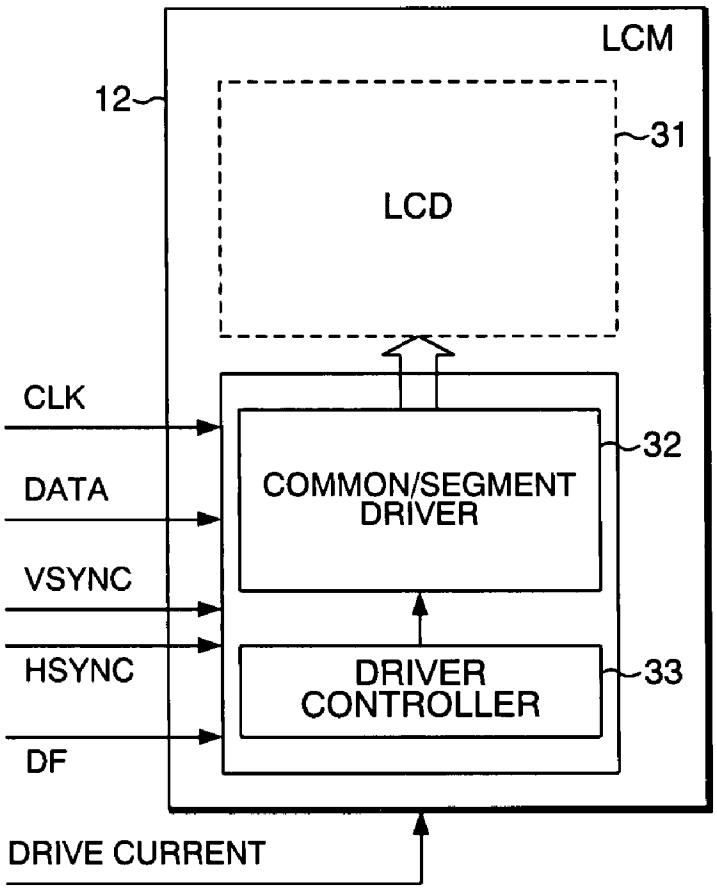
FIG. 4 is a schematic diagram showing the configuration of a liquid crystal module (LCM)

As shown in FIG. 4, the liquid crystal module (LCM) 12 is provided with a liquid crystal display panel (LCD) 31, a common/segment driver 32 which drives the liquid crystal panel, a module controller 33 which performs control over the operation of the driver or others, for example.

The common/segment driver 32 is configured by a CMOS IC (complementary metal oxide semiconductor integrated circuit), for example. The common driver of the common/segment driver 32 is provided with a shift register circuit, a level shifter circuit, a driver circuit, and others, which are not shown. The segment driver of the common/segment driver 32 is provided with a shift register circuit, a latch circuit, a level shifter circuit, a driver circuit, a driver control circuit, and others (not shown). Herein, the latch circuit latches display data, which is transferred as parallel data thereto.

As described above, the common/segment driver 32 of the liquid crystal module (LCM) 12 is provided with an alternating signal (DF signal). The drive voltage is required to be periodically reversed in polarity for application to a liquid crystal device of the liquid crystal panel, and an alternating signal (DF signal) indicates the cycle for such polarity reverse. Accordingly, the liquid crystal panel is subjected to alternating drive (or reverse drive) based on the alternating signal (DF signal). In other words, the polarity of the drive voltage applied to the common and segment electrodes of the liquid crystal module (LCM) 12 is reversed in accordance with the alternating signal (DF signal).

In this embodiment, the liquid crystal module controller 11 is further provided with a peak-current warning signal generation circuit (hereinafter, also simply referred to as warning signal generation circuit) 25. The warning signal generation circuit 25 generates a peak-current warning signal AL for supply to the regulator 13. As will be described in detail later, the regulator 13 operates such that its current supply capability for the liquid crystal module (LCM) 12 is controlled in response to the peak-current warning signal AL.

By referring to the accompanying drawings, the operation of the liquid crystal module controller 11 of the embodiment will be described in detail below.

Figure 5:
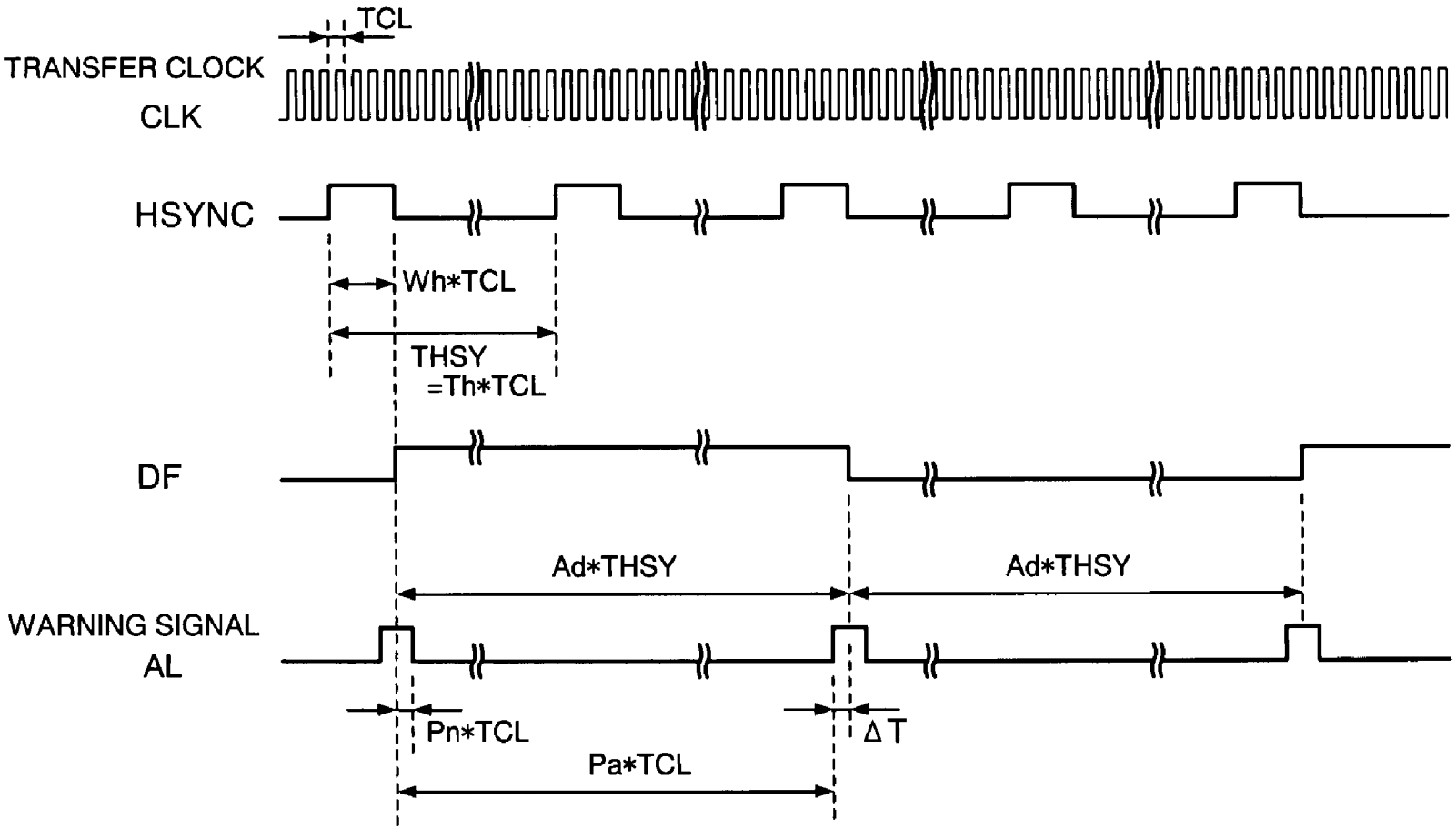
FIG. 5 is a timing chart schematically showing the relationship among a transfer clock (CLK), a horizontal synchronizing signal (HSYNC), a DF signal, and a peak-current warning signal AL in a first embodiment of the present invention.

FIG. 5 is a timing chart schematically showing the relationship among a transfer clock (CLK), a horizontal synchronizing signal (HSYNC), a DF signal, and a peak-current warning signal AL.

The liquid crystal module control section 11 is provided with a register circuit (not shown) which stores therein setting values for generating a peak-current warning signal. The setting values are determined by any predetermined value or externally-input values under the control of the MPU 15. Specifically, determined are the setting values of, respectively, the pulse width (Wh) and cycle (Th) of an HSYNC signal, a reverse cycle (Ad) of a DF signal, and assertion and negation timings of a peak-current warning signal AL (Pa, Pn). FIG. 5 shows an exemplary case with control application with the previously-set timings each as an integer multiple of a cycle TCL of a transfer clock CLK.

More in detail, the pulse width of an HSYNC signal is set to be Wh times of a cycle TCL of a transfer clock CLK (hereinafter, indicated as Wh*TCL), and the cycle THSY of an HSYNC signal is set to THSY=Th*TCL. The reverse cycle of a DF signal is set to Ad*THSY, the setting value relating to the assertion timing of the peak-current warning signal AL is Pa, and the setting value relating to the negation timing of the peak-current warning signal AL is Pn. Note here that, as will be described later, a period when the peak-current warning signal AL is asserted (i.e., warning ON), i.e., an assertion period, is determined by the setting values of Pa, Pn, and Ad*THSY.

Accordingly, the HSYNC signal becomes active for every period of THSY=Th*TCL, and then becomes inactive after being activated for a period of Wh*TCL, i.e., with the lapse of a period of Wh*TCL.

The DF signal is reversed every time the HSYNC signal is negated for Ad number of times, i.e., every time with Ad*THSY=Ad*(Th*TCL).

The peak-current warning signal AL changes in level to a Low level ("Low") with the lapse of a period of Pn*TCL after the DF signal showed a change, i.e., from "High" to "Low", or from "Low" to "High". The peak-current warning signal AL changes in level to "High" with the lapse of a period of Pa*TCL after the DF signal is reversed in polarity. That is, the peak-current warning signal AL changes in level to "High", i.e., asserted (or active), before the DF signal is reversed. As a result, the peak-current warning signal AL becomes in the level of "High" (asserted) for a period of "DF signal cycle−Pa*TCL" (ΔT) before the DF signal is reversed, and serves as a pulse signal remaining in the level of "High" before the lapse of a period of Pn*TCL after the DF signal is reversed. Herein, $\Delta T=[Ad*THSY-Pa*TCL]=[Ad*(Th*TCL)-Pa*TCL]>0$.

With such value setting, it becomes possible to detect any change to be occurred to the DF signal in advance, by the time $\Delta T$, of the occurrence of the change. Accordingly, through supply of a peak-current warning signal AL to the regulator 13, measures can be taken for addressing a current increase when the DF signal is reversed.

Figure 6:
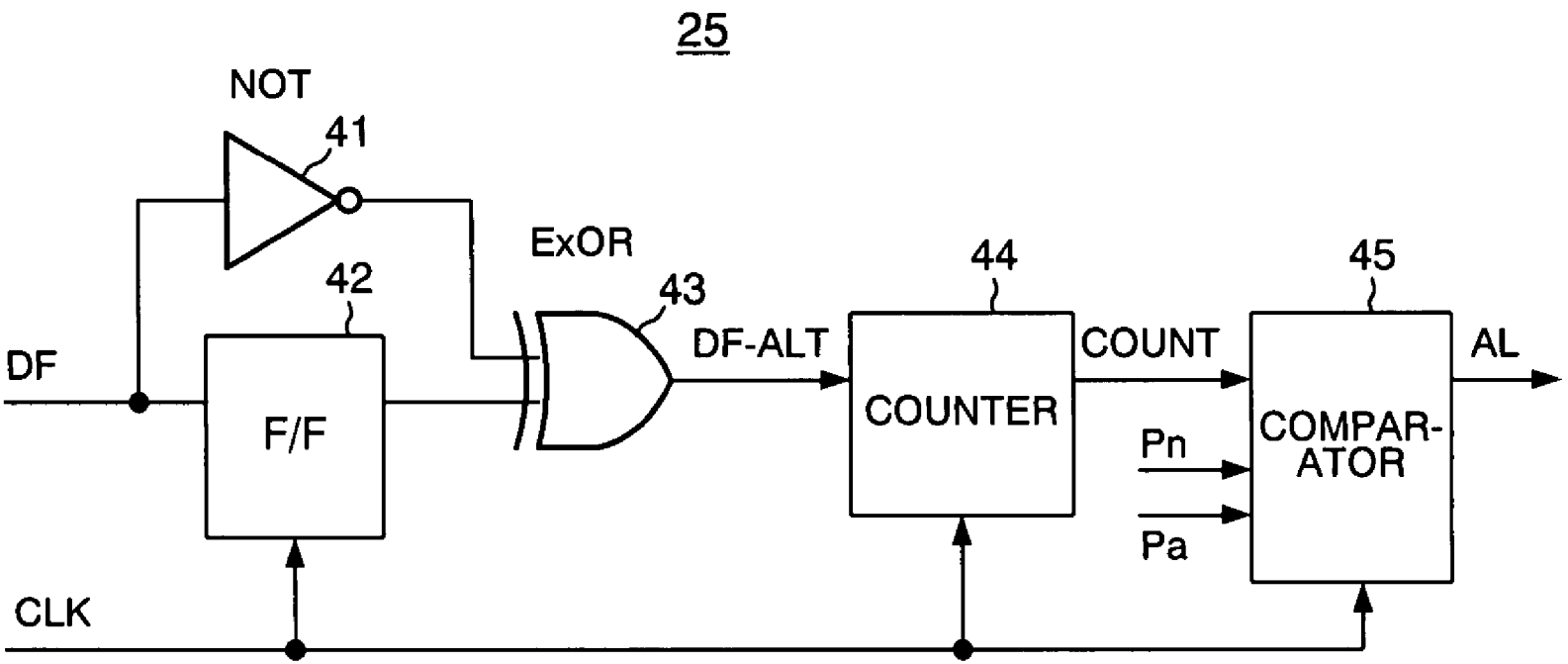
FIG. 6 is a circuit diagram showing a specific example of a peak-current warning signal (AL) generation circuit.
Figure 7:
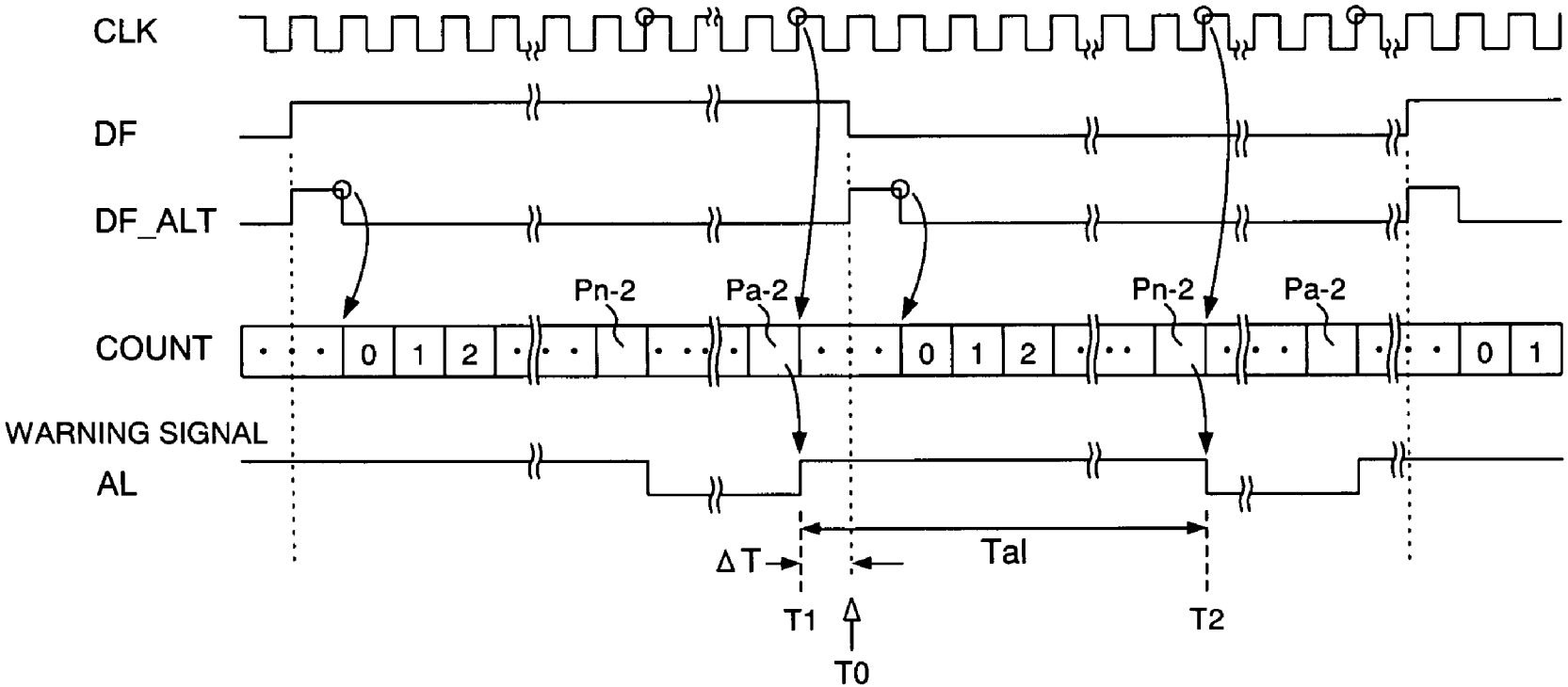
FIG. 7 is a timing chart showing the operation of the peak-current warning signal generation circuit of FIG. 6.

FIG. 6 is a circuit diagram showing an example of the generation circuit 25 of a peak-current warning signal AL, and FIG. 7 is a timing chart showing the operation of the peak-current warning signal generation circuit 25 of FIG. 6.

The warning signal generation circuit 25 is configured to include an inverter (NOT) circuit 41, a flip-flop (F/F) 42, an exclusive OR (ExOR) circuit 43, a counter 44, and a comparator 45.

As shown in FIG. 7, the components, i.e., the inverter (NOT) circuit 41, the flip-flop (F/F) 42, and the exclusive OR circuit (ExOR) 43, generate a DF-ALT signal every time a DF signal is reversed, i.e., from "High" to "Low", or from "Low" to "High". The DF-ALT signal is a signal being in the level of "HIGH" for a single transfer clock period (TCL).

The counter 44 is cleared to 0 (zero) every time the DF-ALT signal changes in level to "High". When the DF-ALT signal is in the level of "Low", the counter 44 increments the transfer clock (CLK). The counter 44 outputs a COUNT signal which indicates a count value.

The comparator 45 receives a COUNT signal, and the setting values of Pa and Pn regarding the assertion and negation timings for the peak-current warning signal AL. The comparator 45 changes in level to "High" with the count value of Pa−2, and generates a peak-current warning signal AL of "Low" level with the count value of Pn−2, for example. As described in the foregoing, as shown in FIGS. 5 and 7, such an expression is established as [DF signal being in period of "High" (or "Low")]>[Pa*TCL]. Therefore, when the count value is Pa−2, (Time T1) is a point of time before, by $\Delta T$, the DF signal is reversed, i.e., time T0 of FIG. 7. After one clock (1 TCL) from the point of time when the DF signal is reversed (time T0), the DF-ALT signal changes in level to "Low", and the counter 44 is cleared so that counting of the clock CLK is started again. Thereafter, when the count value reaches Pn−2 (time T2), the peak-current warning signal AL changes in level to "Low". As such, the resulting peak-current warning signal AL (pulse width: Tal=T2−T1) becomes asserted (warning ON) before the DF signal is reversed (time T0), and changes in level to "Low" (negated: warning OFF) after the DF signal is reversed.

Figure 8:
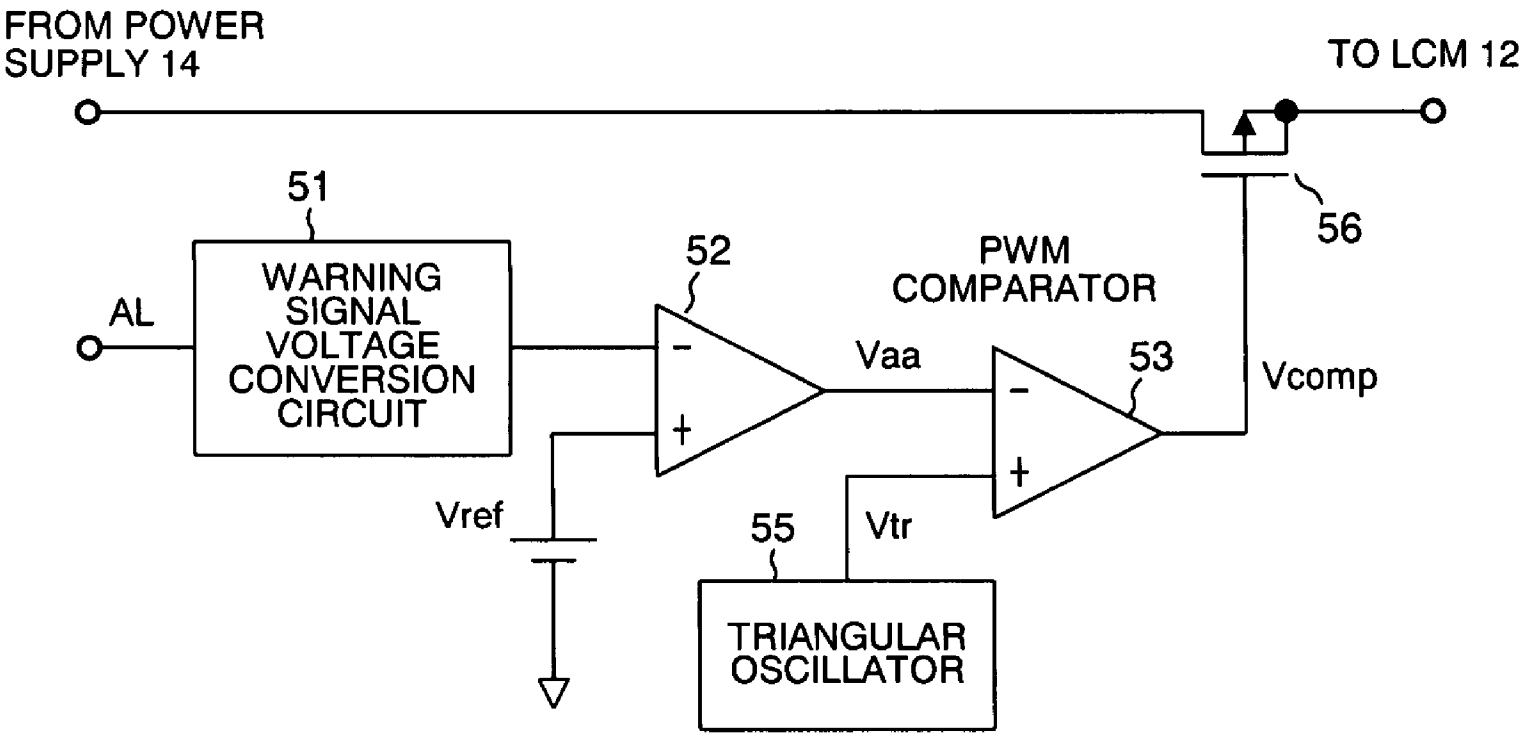
FIG. 8 is a circuit diagram showing an example of a regulator.
Figure 9:
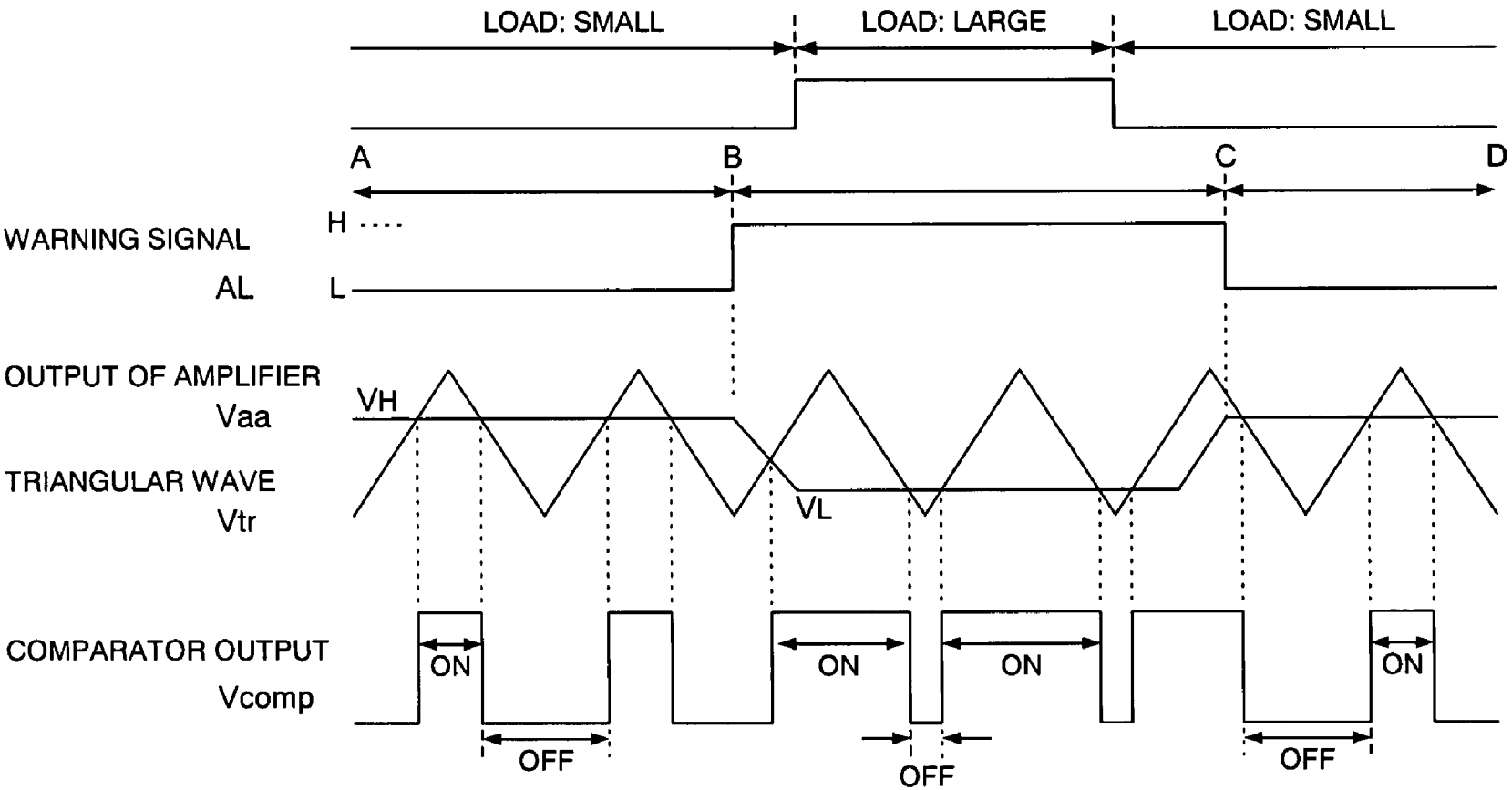
FIG. 9 is a timing chart showing the operation of the regulator shown in FIG. 8.

FIG. 8 is a circuit diagram showing an example of the regulator 13, and FIG. 9 is a timing chart showing the operation of the regulator 13.

The regulator 13 is connected to the power supply 14, and receives the drive power (drive voltage) from the power supply 14. The drive voltage is supplied to the LCM 12 as an output of the regulator via a switch 56.

The regulator 13 also receives a peak-current warning signal AL from the warning signal generation circuit 25. The warning signal AL is converted in voltage by a warning signal voltage conversion circuit 51, and a voltage difference from a predetermined reference voltage Vref is amplified by an amplifier 52.

A differential signal Vaa as a result of amplification is compared with a triangular wave output voltage Vtr in a pulse width modulation (PWM: Pulse Width Modulation) comparator 53. The triangular wave output voltage Vtr is of a triangular wave oscillator 55, which performs triangular wave oscillation with a constant amplitude. By the resulting output signal, the switch 56 is put under the ON/OFF control. The switch 56 is configured by a MOS (metal oxide semiconductor) transistor, for example.

As described above, the warning signal AL is a signal remaining in the level of "High" (warning ON) during a period (Tal) before and after the DF signal is reversed. There thus needs to increase the current supply in the period (Tal) of "High" level (that is, period during the load is large).

With a smaller load, the warning signal generation circuit 25 provides a warning signal AL of "Low" level, and the warning signal AL is converted into a voltage by the voltage conversion circuit 51 to have a larger difference from the reference voltage Vref (section A-B of FIG. 9). This voltage difference is amplified by the amplifier 52 so that an output voltage from the amplifier 52 is increased (voltage VH).

In the PWM comparator 53, the output voltage (voltage VH) is compared with the triangular wave output voltage Vtr. After such a comparison, the PWM comparator 53 outputs the level of "H" ("High") for a period in which the triangular wave output voltage Vtr is higher. In such a period with the output of the PWM comparator 53 being "H", with the switch 56 conducting, the drive current from the regulator 13 is supplied to the LCM 12 as an output of the regulator.

In other words, the output voltage of the amplifier 52 is increased in the period with the warning signal AL being "Low" in level, thereby shortening the period with the output of the PMW comparator 53 being "H" in level. That is, the period with the switch 56 being ON is shortened so that the supply power from the regulator 13 to the LCM 12 can be suppressed in amount.

On the other hand, when a load increase is expected by the warning signal AL, the warning signal AL of "High" in level is supplied from the warning signal generation circuit 25 for provision to the regulator 13. The warning signal AL is converted into the voltage by the voltage conversion circuit 51 to have a smaller difference from the reference voltage Vref (section B-C of FIG. 9). This voltage difference is amplified by the amplifier 52 so that an output voltage from the amplifier 52 is decreased (voltage VL). This increases the period with the output of the PMW comparator 53 being "H" in level, and the period with the switch 56 being ON is elongated so that the power supply from the regulator 13 to the LCM 12 can be increased in amount.

Note here that the regulator 13 may be configured by a linear regulator, a switching regulator, a DC-DC converter, and the like. The warning signal AL may be analog or digital, and may be directly input to the amplifier 52 without going through the voltage conversion circuit 51.

As described above, in the embodiment, a warning signal AL is generated before reverse of an alternating signal (DF signal) to warn the expected increase of a current supply, and the warning signal is used as a basis to control the current supply. As such, unlike with the conventional technology of increasing the amount of power supply after the power is running short, the power supply is increased before a load is actually increased based on the peak-current warning signal so that the power supply can be stably made at all times to the liquid crystal module (LCM). Moreover, because the power supply is increased in amount only when necessary, the power consumption can be favorably reduced.

Further, measures can be taken in advance for addressing a current increase caused by the reverse of an alternating signal without increasing the number of components, the size, and the cost. Additionally, the resulting drive apparatus can be stable in operation with less power consumption for use in a liquid crystal display device.

Second Embodiment

Figure 10:
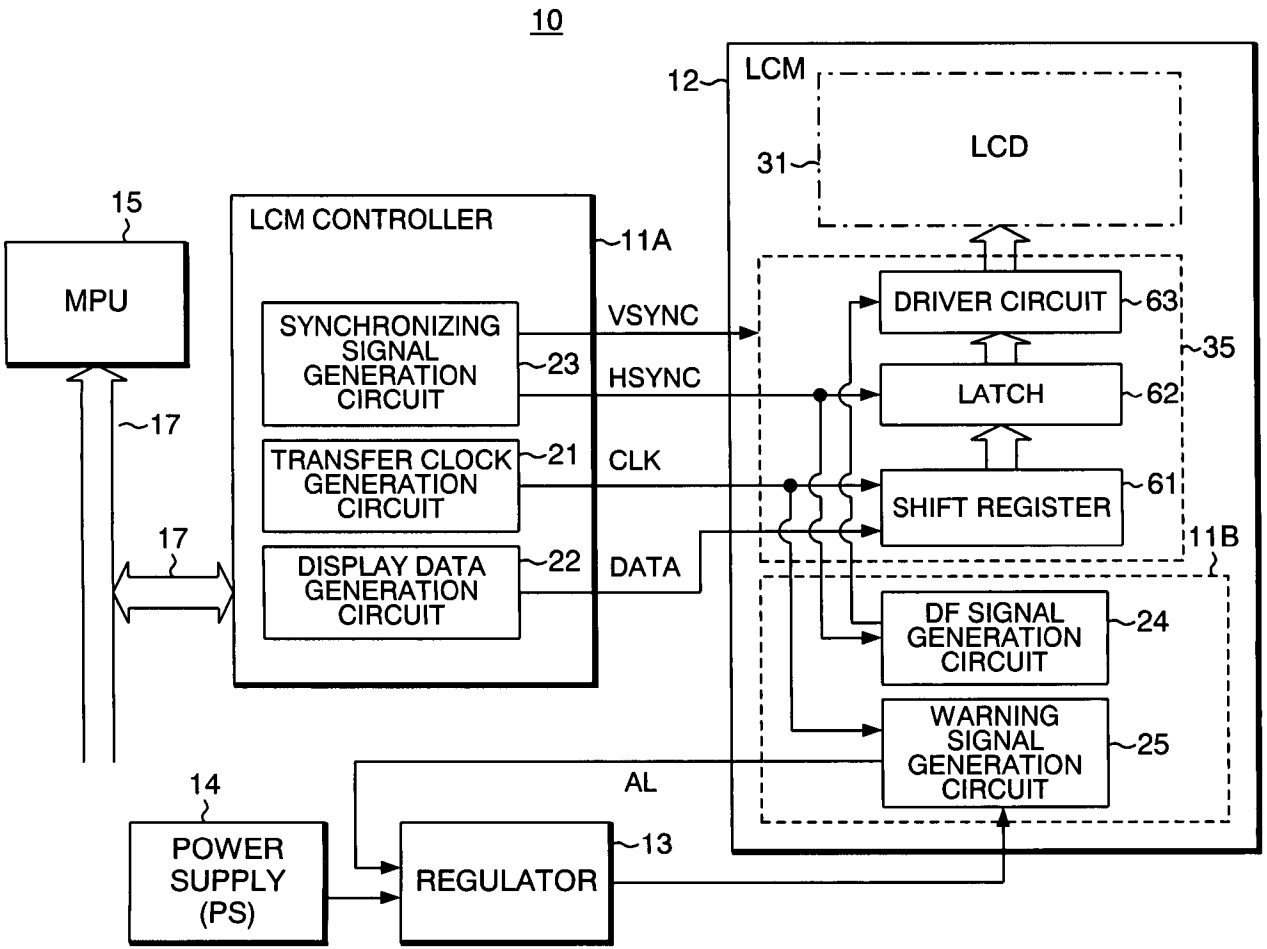
FIG. 10 is a schematic diagram showing the configuration of a liquid crystal display device in a second embodiment of the present invention.

FIG. 10 is a schematic diagram showing the configuration of a liquid crystal display device 10 in a second embodiment of the present invention.

In the embodiment, a liquid crystal module controller is configured by controllers 11A and 11B. The controller 11B including the alternating signal (DF signal) generation circuit 24 and the peak-current warning signal generation circuit 25 is provided in the liquid crystal module (LCM) 12.

The liquid crystal module (LCM) 12 includes a liquid crystal driver 35, which operates as a so-called common/segment driver. In the embodiment, for convenience of description, the liquid crystal driver 35 is assumed as being configured simply by a shift register 61, a latch 62, and a driver circuit 63. The liquid crystal module controller 11A includes the transfer clock generation circuit 21, the display data generation circuit 22, and the synchronizing signal generation circuit 23.

Note here that, similarly to the first embodiment described above, the liquid crystal module controllers 11A and 11B are connected to the microprocessor unit (MPU) 15 via the system bus 17, and performs display control of a liquid crystal display panel (LCD) 31 under the control of the MPU 15.

The display data generation circuit 22 forwards display data to the shift register 61 in synchronization with a transfer clock CLK, and the serial data is converted into the parallel data. When the shift register 61 stores therein data of a single display line, a horizontal synchronizing signal (HSYNC) comes from the synchronizing signal generation circuit 23, and the data of the shift register 61 is latched by the latch 62.

Based on the data latched by the latch 62, the driver circuit 63 drives the liquid crystal display panel (LCD) 31 so that the data is displayed. At this time, the alternating signal (DF signal) generation circuit 24 provided in the liquid crystal module (LCM) 12 generates an alternating signal (DF signal), which periodically reverses the polarity of a drive voltage for application to a liquid crystal device of the liquid crystal panel. The alternating signal (DF signal) is supplied to the driver circuit 63.

At this time, the DF signal generation circuit 24 receives a horizontal synchronizing signal (HSYNC), and performs frequency division of the horizontal synchronizing signal (HSYNC) to generate a DF signal. The frequency division ratio is set to a predetermined frequency (or cycle), which leads to optimum alternating drive (reverse drive) for the liquid crystal drive control.

The peak-current warning signal generation circuit 25 has the configuration similar to that of the first embodiment.

Also similarly to the first embodiment described above, in response to the supply of a warning signal AL which is asserted before, by $\Delta T$, the DF signal is reversed, the regulator 13 controls the current supply capability for the liquid crystal driver 35 so that it is possible to address a current increase when the DF signal is reversed.

Also in the embodiment, the peak-current warning signal generation circuit 25 is provided in the liquid crystal module (LCM) 12. That is, the components, i.e., the liquid crystal display panel 31, the liquid crystal driver 35, and the warning signal generation circuit 25, configure the liquid crystal module (LCM) as a piece. With such a configuration, in the second embodiment, the liquid crystal module (LCM) is allowed to have general versatility, and it is possible to address agaist current increase when the DF signal is reversed.

The foregoing description is in all aspects illustrative and not restrictive, and a display device or others to be applied can be variously modified as appropriate.

While the invention has been described in detail by referring to the embodiments considered preferable. It is understood that those skilled in the art may conceive various modifications and variations to the embodiments, and the accompanying claims entirely may cover such modifications and variations.

This application is based on Japanese Patent Application No. 2005-316221 which is hereby incorporated by reference.

What is claimed is:

1. A drive control apparatus for use in a liquid crystal display device that applies, based on display data, a liquid crystal drive voltage to an electrode of a liquid crystal display panel for display, the apparatus comprising:

a polarity reversing section which generates a polarity reversing signal for reversing a polarity of the liquid crystal drive voltage;

a liquid crystal driver which reverses the polarity of the liquid crystal drive voltage based on the polarity reversing signal to drive the liquid crystal display panel;

a warning signal generation section which generates a warning signal indicating a polarity reversal of the liquid crystal drive voltage, the warning signal being asserted prior to a polarity reversal and remaining asserted for a period of time until after the polarity reversal; and a regulator section which extends a current supply period of the liquid crystal driver in accordance with the warning signal.

2. The drive control apparatus according to claim 1, wherein the warning signal generation section generates the warning signal on the basis of a horizontal synchronizing pulse of the liquid crystal display device for every predetermined number of the horizontal synchronizing pulses.

3. The drive control apparatus according to claim 1, wherein the warning signal generation section generates the warning signal based on a cycle of the polarity reversing signal and a count value of a transfer clock of the display data.

4. The drive control apparatus according to claim 1, wherein the liquid crystal display panel, the liquid crystal driver, and the warning signal generation section are configured as a piece.

5. A drive control apparatus according to claim 1, further comprising:

a register which in advance stores therein a length of the period of the warning signal;

wherein the regulator section extends a current supply period of the liquid crystal driver in accordance with a stored length of the warning signal.

* * * * *